US005452690A

United States Patent [19]

Kobayashi

[11] Patent Number: 5,452,690

[45] Date of Patent: Sep. 26, 1995

[54] STRUCTURE OF HEAD COVER

[75] Inventor: Tsutomu Kobayashi, Shizuoka, Japan

[73] Assignee: Suzuki Motor Corporation, Shizuoka, Japan

[21] Appl. No.: 301,190

[22] Filed: Sep. 6, 1994

[30] Foreign Application Priority Data

Oct. 30, 1993 [JP] Japan ..... 5-294345

[51] Int. Cl.[6] ..... F01M 9/10

[52] U.S. Cl. ..... 123/90.38; 123/195 C

[58] Field of Search ..... 123/90.33, 90.38, 123/195 C

[56] References Cited

U.S. PATENT DOCUMENTS

| | | | |
|---|---|---|---|
| 4,993,375 | 2/1991 | Akihiko | 123/90.38 |
| 5,003,958 | 4/1991 | Yoneyama et al. | 123/90.38 |
| 5,129,371 | 7/1992 | Rosalik, Jr. | 123/90.38 |
| 5,228,420 | 7/1993 | Furuya et al. | 123/90.38 |
| 5,255,647 | 10/1993 | Kiczek | 123/195 C |
| 5,311,847 | 5/1994 | Boehning | 123/90.38 |
| 5,323,740 | 6/1994 | Daily et al. | 123/90.38 |
| 5,323,745 | 6/1994 | Sato et al. | 123/90.38 |

FOREIGN PATENT DOCUMENTS 63-37461 10/1988 Japan .

*Primary Examiner*—Henry C. Yuen
*Assistant Examiner*—Weilun Lo
*Attorney, Agent, or Firm*—Flynn, Thiel, Boutell & Tanis

[57] ABSTRACT

The structure of a head cover mounted on a cylinder head of an engine, wherein an upper plate portion of the head cover is dented at respective regions corresponding to mounting locations of a plurality of spark plugs, whereby the head cover has the upper plate portion formed with dented grooves; the dented grooves have bottom plate portions defined with spark plug insertion-through-portions; the upper plate portion is formed with coil-mounting portions for ignition coils on both sides of the spark plug insertion-through-portions in the longitudinal direction parallel to the axis of a crank shaft; one side of the upper plate portion, which is defined with the coil-mounting portions, in a transverse direction perpendicular to the axis of the crank shaft, is dented to provide communication grooves which intercommunicate the dented grooves. The communication grooves terminate at a peripheral flange portion of the head cover at one of the ends of the head cover in the longitudinal direction parallel to the axis of the crank shaft.

2 Claims, 11 Drawing Sheets

STRUCTURE OF HEAD COVER

FIELD OF THE INVENTION

This invention relates to a head cover structure and, more particularly, to a head cover structure which is adapted to ensure a sufficient bleeder chamber capacity, and to provide increased rigidity, reduced weight, and low noise and/or reduced vibration.

BACKGROUND OF THE INVENTION

Among engines mounted on vehicles and the like, there is one type of engine in which a cylinder block has a plurality of cylinders aligned with one another. A plurality of spark plugs are serially arranged in a row within a cylinder head positioned above the cylinders. There is another type of engine in which the cylinder head has a head cover mounted thereon for covering a valve-actuating mechanism such as a cam shaft.

FIGS. 13 through 15 illustrate a head cover structure mounted on a cylinder head of an engine in which a plurality of spark plugs are fitted in the cylinder head, as described above. In these figures, the head cover 102 is mounted on an engine cylinder head (not shown).

In the engine, a cylinder block has a plurality of cylinders (not shown) aligned with one another. While being located above the plurality of cylinders, the plurality of spark plugs (not shown) are placed at a central portion of the cylinder head in a transverse direction perpendicular to axis C of a crank shaft (not shown). The plurality of spark plugs are arranged in a row in series along a longitudinal direction parallel to axis C.

In addition, the engine is not provided with a distributor, but is provided with a so-called distributorless ignition (DLI) in which an ignition coil is provided for each of the cylinders. The ignition coils are mounted directly onto head portions of the spark plugs which are fitted in the cylinder head.

The cylinder head has the head cover 102 mounted thereon for covering a valve-actuating mechanism such as a cam shaft. The head cover 102 is formed by a peripheral platelike flange portion 104 and an upper plate portion 106. The peripheral flange portion 104 forms the periphery of the head cover 102. The upper plate portion 106 is surrounded by the peripheral flange portion 104. The upper plate portion 106 is dented inwardly to provide an elongated groove 108, whereby the head cover 102 has the upper plate portion 106 defined with the elongated groove 108 therein. The elongated groove 108 is provided by the denting of a central portion of the upper plate portion 106 in the transverse direction perpendicular to axis C in such a manner that the elongated groove 108 is located at a position corresponding to locations where the plurality of spark plugs are fitted in the cylinder head. The above denting is conducted to a stage where the elongated groove 108 terminates at the peripheral flange portion 104 at least at one end of the upper plate portion 106 in the longitudinal direction parallel to crank shaft axis C.

The elongated groove 108 is formed by a bottom plate portion 110 and side plate portions 112, the latter being located at both sides of the former. The bottom plate portion 110 is formed with a plurality of spark plug insertion-through-portions 114, through which the plurality of spark plugs are individually inserted. The spark plug insertion-through-portions 114 are provided through the bottom plate portion 110 at respective positions corresponding to the locations where the spark plugs are fitted in the cylinder head. Further, the spark plug insertion-through-portions 114 are defined with spark plug insertion holes 116. When water or the like lodges in the elongated groove 108 around the spark plug insertion-through-portions 114, such is caused to flow to the open end of the elongated groove 108 in the longitudinal direction parallel to axis C. The water is then discharged outside.

The bottom plate portion 110 is further formed with coil-mounting portions 120 for ignition coils 118 (FIG. 15) which are mounted onto the spark plugs. Each of the coil-mounting portions 120 has a cylindrical shape, and is supported by supporting ribs 122. The coil-mounting portions 120 are positioned on both sides of the spark plug insertion-through-portions 114 in the longitudinal direction parallel to axis C. The coil-mounting portions 120 are provided on the bottom plate portion 110, and are disposed on opposite sides of the respective portion 114, to define a cooperative pair. Each ignition coil 118 is mounted onto a cooperative pair of coil-mounting portions 120 by mounting screws 126 threadingly engaged with coil-mounted holes 124 formed in the coil-mounting portions 120.

Moreover, the head cover 102 has bleeder chambers 128 (FIG. 14) formed on both sides of the elongated groove 108 in the transverse direction perpendicular to axis C. Through the raising of the peripheral flange 104 of the head cover 102 and the upper plate portion 106 on both sides of the elongated groove 108, the bleeder chambers 128 are defined by the peripheral flange portion 104, the upper plate portion 106, the side plate portions 112 of the elongated groove 108, and a bleeder plate 130.

One example of the above-described head cover structure is disclosed in Japanese Utility Model Application Examined No. 63-37461 (1988). According to the head cover disclosed in this publication, first and second chambers for separating oil from blow-by gases are provided within the head cover. The first and second chambers are spaced apart from each other by a predetermined gap. The first chamber is interposed in a first blow-by passageway that intercommunicates the interior of the head cover and an air intake passageway on an upstream side of a throttle valve. The second chamber is located in a second blow-by passageway that intercommunicates the interior of the head cover and the air intake passageway at a downstream side of the throttle valve. Further, there is provided an opening for introducing blow-up gases from a space defined by the gap between the first and second chambers. The opening is formed at a side wall portion of at least one of the first and second chambers.

A head cover 102 as shown in FIGS. 13 through 15 is formed with an elongated groove 108 having an invariable cross-sectional shape. The elongated groove 108 extends continuously along a longitudinal direction parallel to axis C. This configuration has a problem of being incapable of ensuring a sufficient capacity of the bleeder chambers 128. As a result, there are inconveniences in that the bleeder chambers 128 have a reduced capacity, and the performance of separating oil from blow-by gases cannot be enhanced, thereby increasing oil consumption.

In the conventional head cover 102, coil-mounting portions 120 for the ignition coils 118 are formed on a bottom plate portion 110 in the elongated groove 108. For this reason, the coil-mounting portions 120 must be formed into a cylindrical shape. However, these cylindrical-shaped components create another problem in that the head cover 102 is deficient in self-supporting rigidity. Accordingly, there are inconveniences in that it is necessary to form supporting ribs 122 for increasing the self-supporting rigidity of the coil-mounting portions 120, thereby increasing the weight of the head cover 102.

As mentioned above, the conventional head cover 102 is formed with the elongated groove 108 having the invariable cross-sectional shape. More specifically, the bottom plate portion 110 of the elongated groove 108 as well as the side plate portions 112 on both sides of the bottom plate portion 110 are formed into a planar plate shape. This configuration causes problems in that the head cover 102 fails to ensure sufficient strength, and tends to resonate with noise and/or vibration resulting from engine actuation. As a result, there are inconveniences in which the rigidity of the head cover 102 is impaired, and noise emission and vibration caused by engine actuation are difficult to control.

In order to obviate the above-described inconveniences, the present invention provides a structure of a head cover mounted on a cylinder head of an engine in which a plurality of spark plugs are disposed at a central portion of the cylinder head in a transverse direction perpendicular to an axis of a crank shaft, the plurality of spark plugs being aligned with one another in a longitudinal direction parallel to the axis of the crank shaft, the structure of the head cover being characterized in that: an upper plate portion of the head cover is dented at respective regions corresponding to locations where the plurality of spark plugs are fitted in the cylinder head, whereby the head cover has the upper plate portion formed with dented grooves; the dented grooves have bottom plate portions defined with spark plug insertion-through-portions, through which the plurality of spark plugs are inserted; the upper plate portion has coil-mounting portions formed on both sides of the spark plug insertion-through-portions in the longitudinal direction parallel to the axis of the crank shaft, the coil-mounting portions being provided for mounting ignition coils directly onto the plurality of spark plugs; one of both sides of the upper plate portion, which is defined with the coil-mounting portions, in the transverse direction perpendicular to the axis of the crank shaft is dented to provide communication grooves which intercommunicate the dented grooves, the communication grooves terminating at a peripheral flange portion of the head cover at one of the ends of the head cover in the longitudinal direction parallel to the axis of the crank shaft, whereby the head cover has the upper plate portion formed with the communication grooves; and the head cover has bleeder chambers formed inside the upper plate portion that is defined with the coil-mounting portions, the bleeder chambers being positioned on the other side of the upper plate portion in the transverse direction perpendicular to the axis of the crank shaft.

According to the present invention having the aforesaid structure, an upper plate portion is dented at respective regions corresponding to locations where a plurality of spark plugs are fitted in a cylinder head, whereby a head cover has the upper plate portion formed with dented grooves. Further, the upper plate portion is dented to provide communication grooves which intercommunicate the dented grooves. The communication grooves terminate at a peripheral plate portion of the head cover. The head cover thereby has the upper plate portion formed with the communication grooves. As a result, the head cover is configured to have different groove shapes in cross-section. This configuration can increase the strength of the head cover without adding to the weight thereof.

Furthermore, in the head cover, the upper plate portion has a coil-mounting portion formed on each side of a spark plug insertion-through-portion in the longitudinal direction parallel to the axis of a crank shaft. The coil-mounting portions are provided for mounting ignition coils directly onto the spark plugs. This structure eliminates the need for conventional cylindrical-shaped coil-mounting portions. Accordingly, this feature can eliminate supporting ribs for enhancing the self-supporting rigidity of the coil-mounting portions.

Moreover, denting is made to one of the sides of the upper plate portion, which is defined with the coil-mounting portions, in a transverse direction perpendicular to the axis of the crank shaft. The head cover thereby has the upper plate portion formed with the communication grooves. The communication grooves intercommunicate the dented grooves, and terminate at the peripheral flange portion of the head cover. The head cover further has bleeder chambers formed inside the upper plate portion that is defined with the coil-mounting portions. The bleeder chambers are positioned on the other side of the upper plate portion in the transverse direction perpendicular to the axis of the crank shaft. This construction allows for an increased capacity of the bleeder chambers.

DETAILED DESCRIPTION

An embodiment of the present invention will be described with reference to FIGS. 1 through 12.

Figure 12:
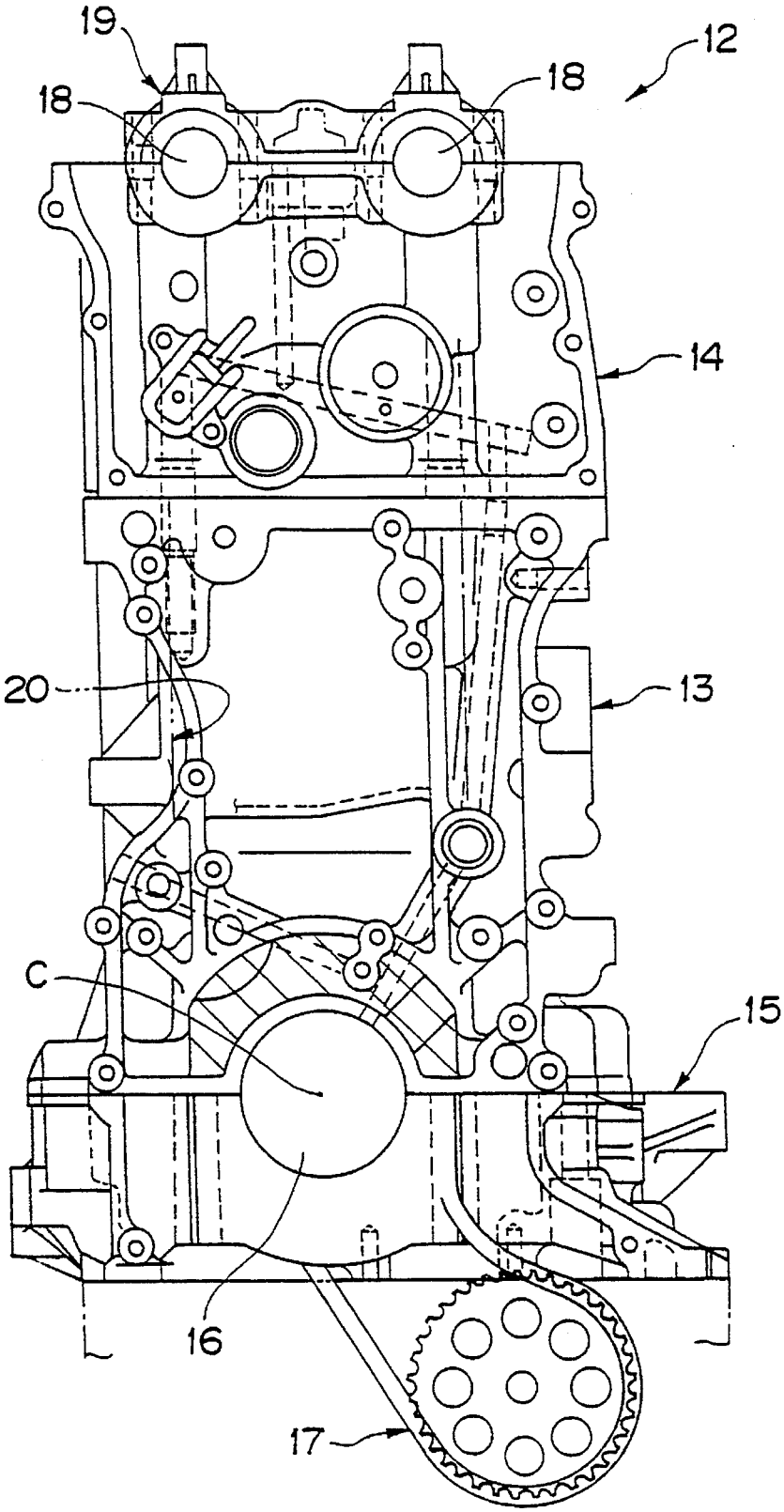
FIG. 12 is a front view illustrating an engine.

In FIG. 12, reference numerals 12, 13, 14 and 15 respectively denote an engine, a cylinder block, a cylinder head, and a lower case. The cylinder block 13 has a crank shaft 16 rotatably supported by the lower case 15. The crank shaft 16 drives an oil pump 17 which is mounted on the lower case 15. The cylinder head 14 has cam shafts 18 rotatably supported by cam shaft housings 19. The cam shafts 18 form a valve-actuating mechanism.

In the engine 12, the cylinder block 13 has a plurality of cylinders 20 arranged in a row in series along a longitudinal direction parallel to axis C of the crank shaft 16. The present embodiment employs four cylinders 20 which are aligned with one another.

As shown in FIGS. 8 through 11, the cylinder head 14 is defined with a plurality of combustion chamber cavities 21 which are configured to match the cylinders 20. The combustion chamber cavities 21 are aligned with one another in the longitudinal direction parallel to axis C of the crank shaft 16. The cylinder head 14 is further formed with spark plug-tapped holes 24 for spark plugs 22 to be fitted therein. The spark plug-tapped holes 24 are oriented toward the centers of the cylinders 20, and are positioned above the combustion chamber cavities 21. Moreover, the cylinder head 14 is formed with spark plug insertion holes 25 which extend continuously from the spark plug-tapped holes 24.

The spark plug-tapped holes 24 are formed at a central portion of the cylinder head 14 in a transverse direction perpendicular to axis C of the crank shaft 16. In addition, the spark plug-tapped holes 24 are arranged in a row in series along the longitudinal direction parallel to axis C of the crank shaft 16. This arrangement permits the plurality of spark plugs 22 to be placed at a central portion of the engine 12 in the transverse direction perpendicular to axis C of the crank shaft 16. Further, while being positioned above the cylinders 20, the spark plugs 22 are aligned with one another in the longitudinal direction parallel to axis C of the crank shaft 16.

The engine 12 is not provided with a distributor, but is provided with a so-called distributorless ignition (DLI) for feeding a spark to the spark plugs 22, which are fitted in the cylinder head 14, for each of the cylinders 20.

As shown in FIGS. 1 through 7, the engine 12 has a head cover 26 mounted on the cylinder head 14. The head cover 26 covers a valve-actuating mechanism such as the cam shafts 18. The head cover 26 is formed by a peripheral platelike flange portion 28 and an upper plate portion 30. The peripheral plate portion 28 forms the periphery of the head cover 26. The upper plate portion 30 is surrounded by the peripheral plate portion 28. The head cover 26 is formed with dented grooves 32 at portions corresponding to locations at which the plurality of spark plugs 22 are fitted in the cylinder head 14. The dented grooves 32 are provided by the denting of the upper plate portion 30 at respective regions which correspond to the locations of the spark plugs 22 being fitted in the cylinder head 14.

Each of the dented grooves 32 is formed by a bottom plate portion 34, side plate portions 36, and end plate portions 38. The bottom plate portion 34 is parallel to but positioned downwardly from the upper plate portion 30. The side plate portions 36 are located on opposite sides of the bottom plate portion 34 in the transverse direction perpendicular to axis C of the crank shaft 16. The end plate portions 38 are located on opposite sides of the bottom plate portion 34 in the longitudinal direction parallel to axis C of the crank shaft 16. Further, for each of the dented grooves 32, the bottom plate portion 34 is defined with a spark plug insertion-through-portion 40, through which the respective spark plug 22 is inserted.

The spark plug insertion-through-portions 40 are provided through the bottom plate portions 34 at respective regions corresponding to the locations where the spark plugs 22 are mounted in the cylinder head 14. Further, the plurality of spark plug insertion-through-portions 40 are formed with spark plug insertion-through-holes 42. The spark plug insertion-through-holes 42 are open to the spark plug-tapped holes 24 of the cylinder head 14.

The upper plate portion 30 has a coil-mounting portion 46 (FIGS. 5 and 6) formed on each side of the spark plug insertion-through-portions 40 in the longitudinal direction parallel to axis C of the crank shaft 16. The coil-mounting portions 46 are provided for mounting ignition coils 44 directly onto the spark plugs 22. For each of the cylinders 20, the ignition coil 44 is attached directly onto a head portion of the spark plug 22 which is fitted in the cylinder head 14. A spark is thereby fed directly to the spark plug 22.

The coil-mounting portions 46 are provided by a couple which includes a coil engagement pin 48 and a coil-tapped hole 50. The upper plate portion 30 has the coil engagement pins 48 and the coil-tapped holes 50 located alternately on each side of the spark plug insertion-through-portions 40 in the longitudinal direction parallel to axis C. The ignition coil 44 is formed with a coil side engagement hole 52 (FIG. 6) and a coil side insertion-through-hole 54 which respectively fit the coil engagement pin 48 and coil-tapped hole 50 of the coil-mounting portion 46.

The ignition coils 44 are mounted on the cylinder head 14 by the engagement of the coil side engagement holes 52 with the coil engagement pins 48 of the coil-mounting portions 46, and further by threading engagement of coil-mounting screws 56, which are inserted through the coil side insertion-through-holes 54 with the coil-tapped holes 50 of the coil-mounting portions 46. The ignition coils 44 are thereby attached directly onto the head portions of the spark plugs 22.

The head cover 26 is further formed with communication grooves 58. The communication grooves 58 are provided by denting of the upper plate portion 30 between the dented grooves 32, which grooves 58 are defined adjacent the coil-mounting portions 46. That is, one side of the upper plate portion 30 in the transverse direction perpendicular to axis C of the crank shaft 16 is dented to form the communication grooves 58. The communication grooves 58 permit the dented grooves 32 to be in longitudinal communication with one another. The communication grooves 58 terminate at the peripheral flange portion 28 at one end of the head cover 26 in the longitudinal direction parallel to axis C.

Figure 1:
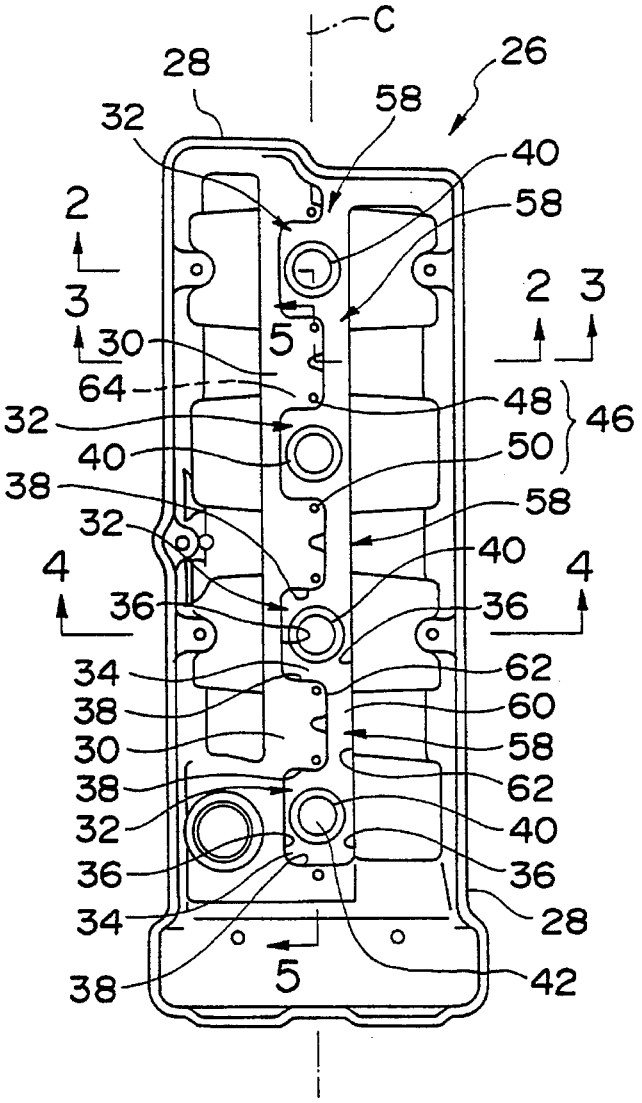
FIG. 1 is a plan view illustrating a head cover according to an embodiment of the present embodiment.
Figure 2:
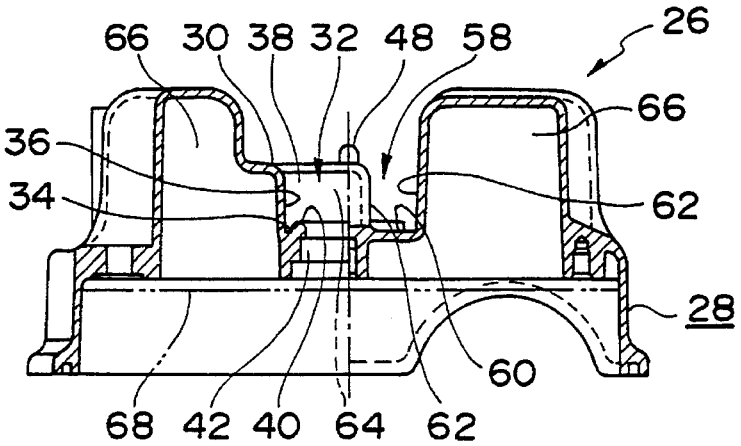
FIG. 2 is an enlarged cross-sectional view taken along line 2—2 of FIG. 1.
Figure 3:
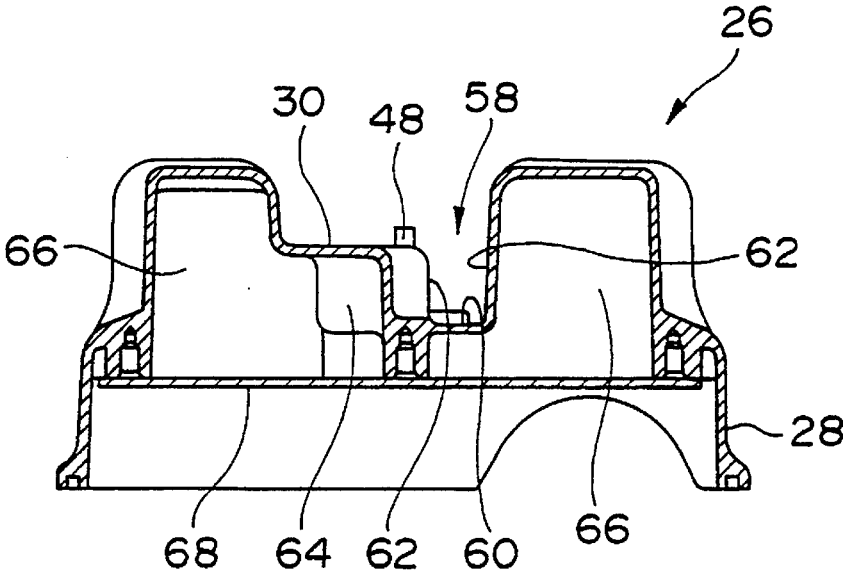
FIG. 3 is an enlarged cross-sectional view taken along line 3—3 of FIG. 1.
Figure 4:
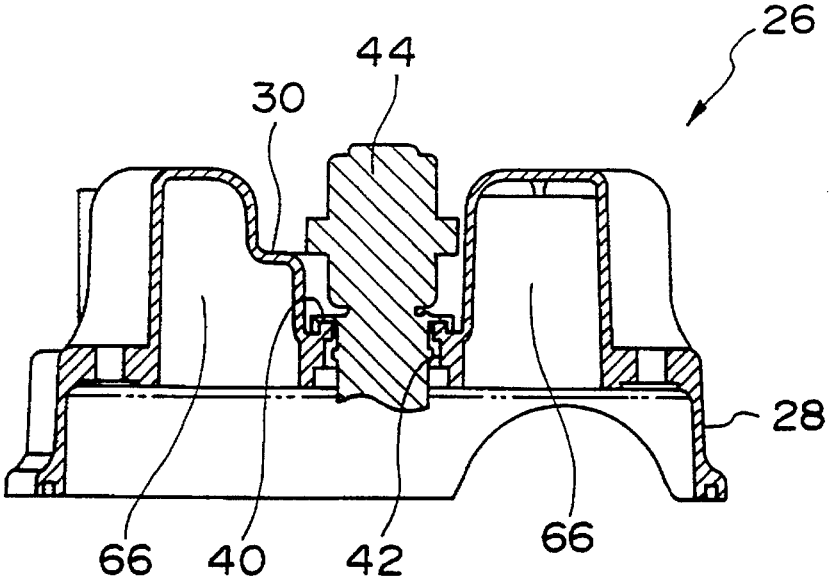
FIG. 4 is an enlarged cross-sectional view taken along line 4—4 of FIG. 1, and illustrating a state in which an ignition coil is mounted on the head cover.
Figure 5:
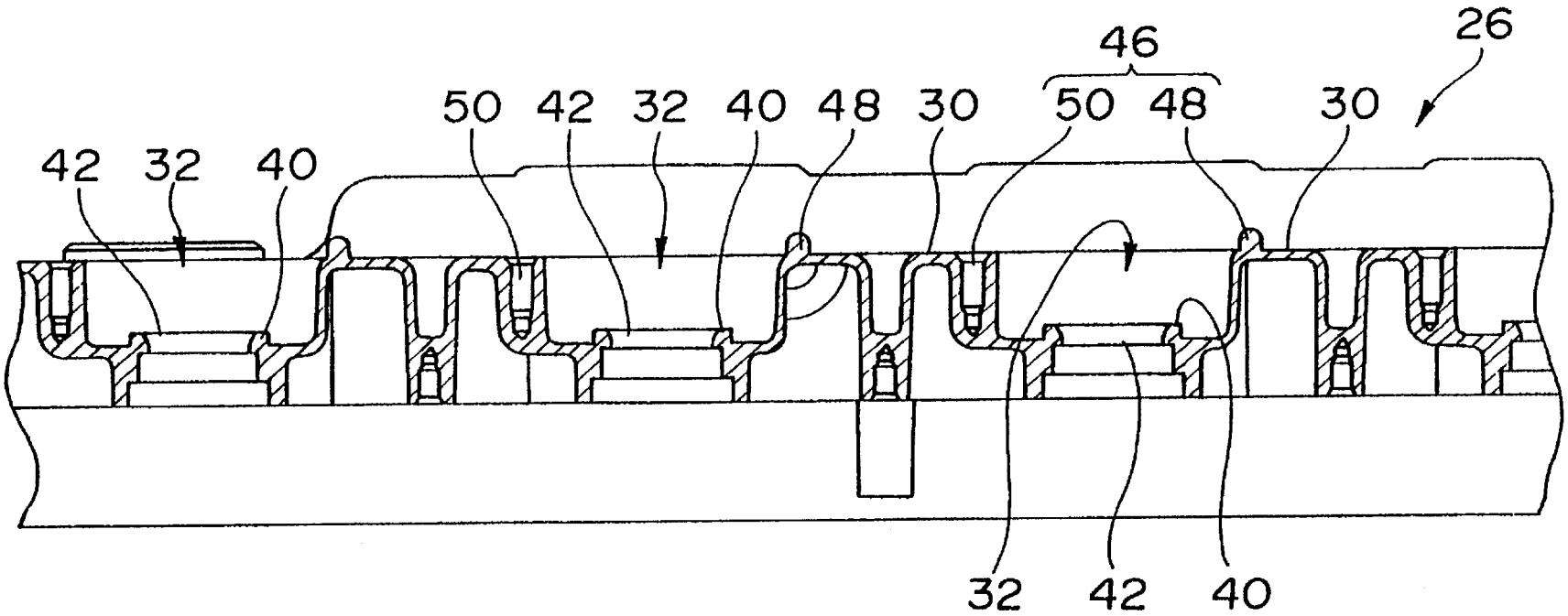
FIG. 5 is an enlarged cross-sectional view taken along line 5—5 of FIG. 1.
Figure 6:
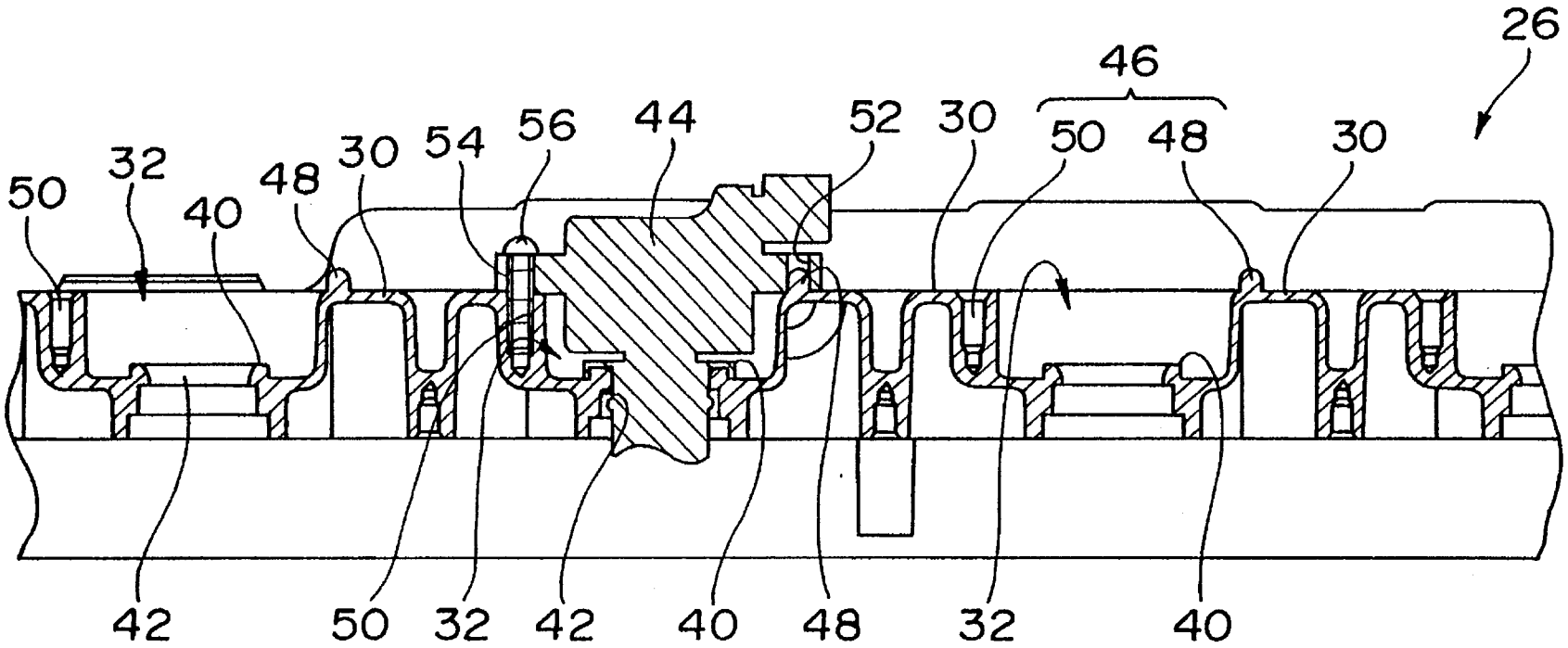
FIG. 6 is an enlarged cross-sectional view taken along line 6—6 of FIG. 1, and illustrating a state in which the ignition coil is mounted on the head cover.
Figure 7:
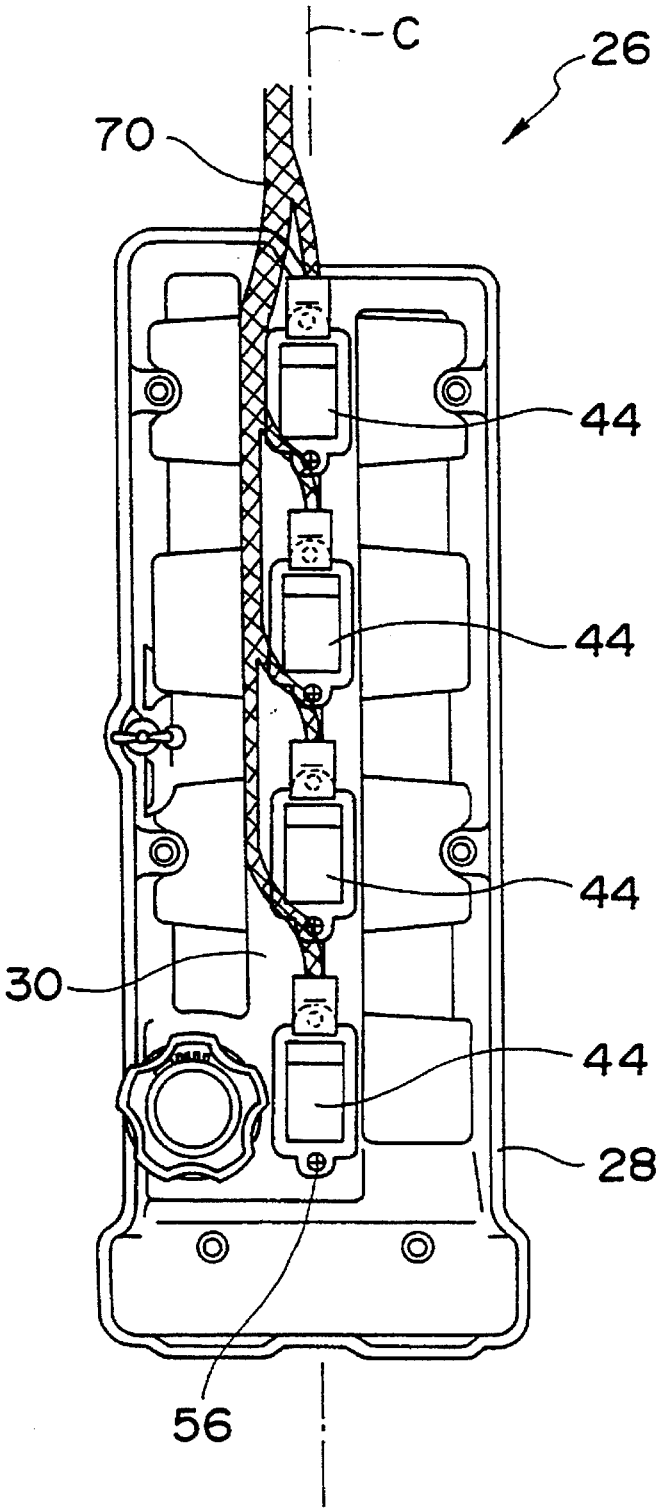
FIG. 7 is a plan view illustrating a state in which the head cover has the ignition coils mounted thereon.
Figure 8:
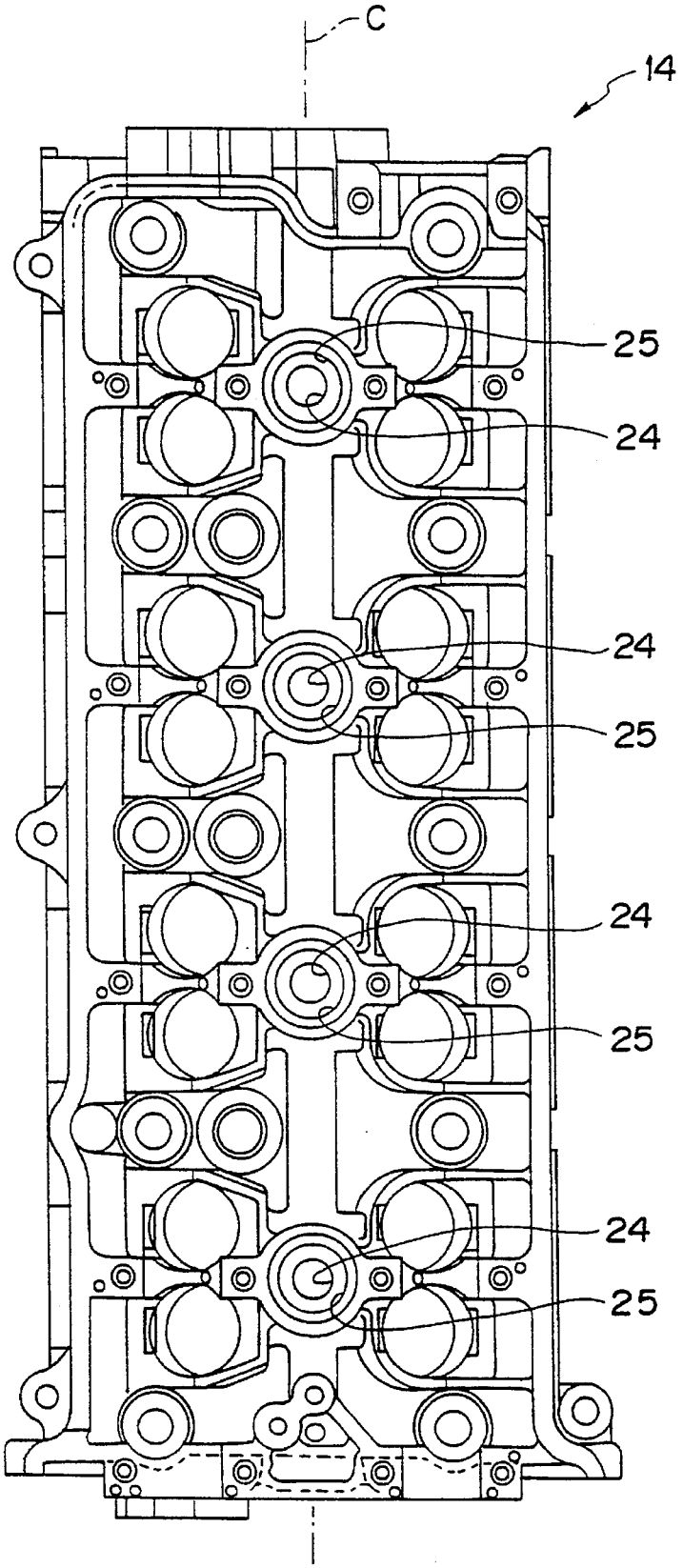
FIG. 8 is a plan view showing a cylinder head.
Figure 9:
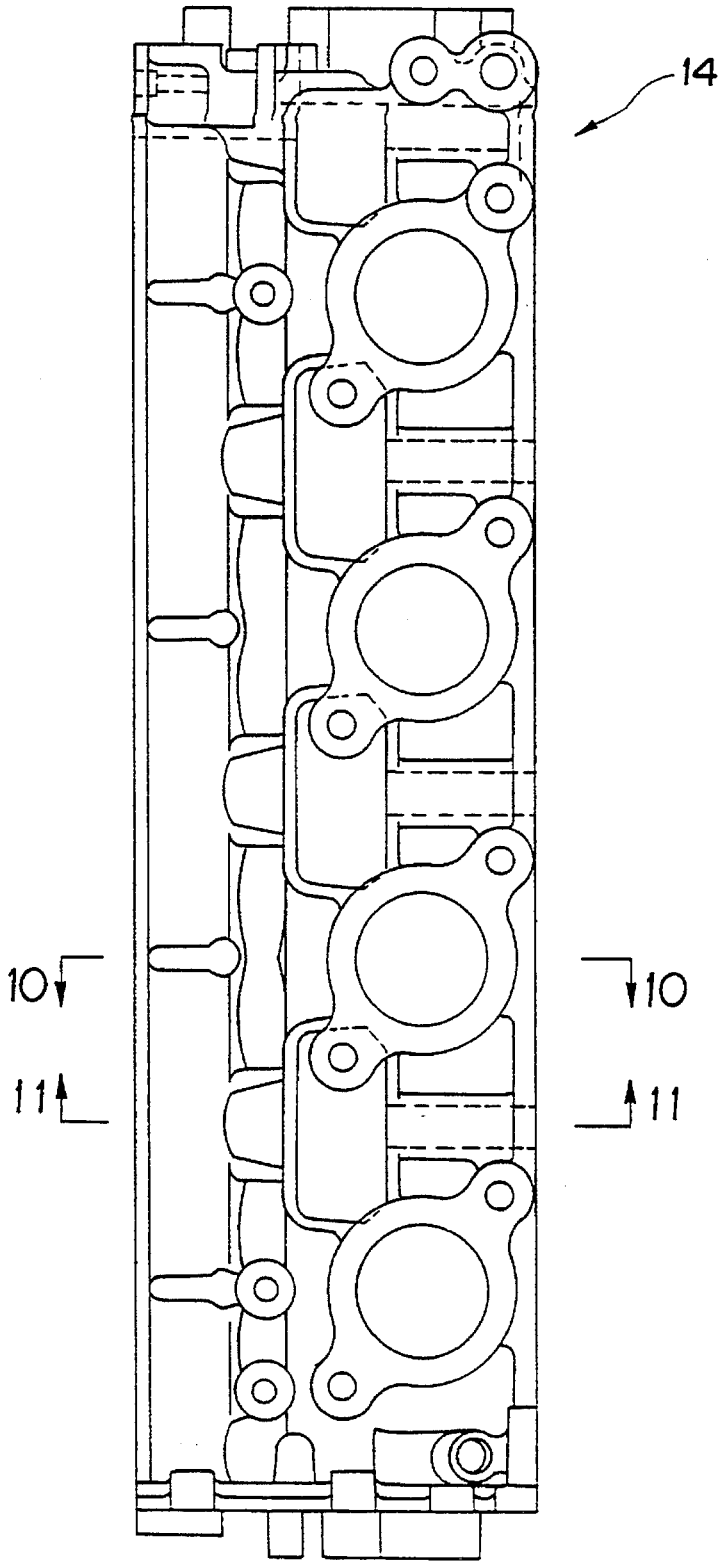
FIG. 9 is a side view showing the cylinder head.
Figure 10:
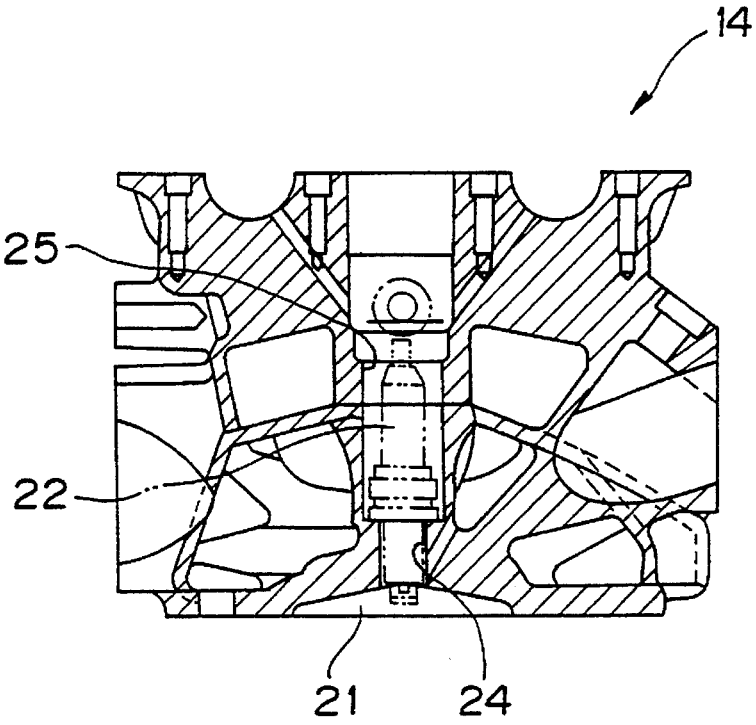
FIG. 10 is a cross-sectional view taken along line 10—10 of FIG. 9.
Figure 11:
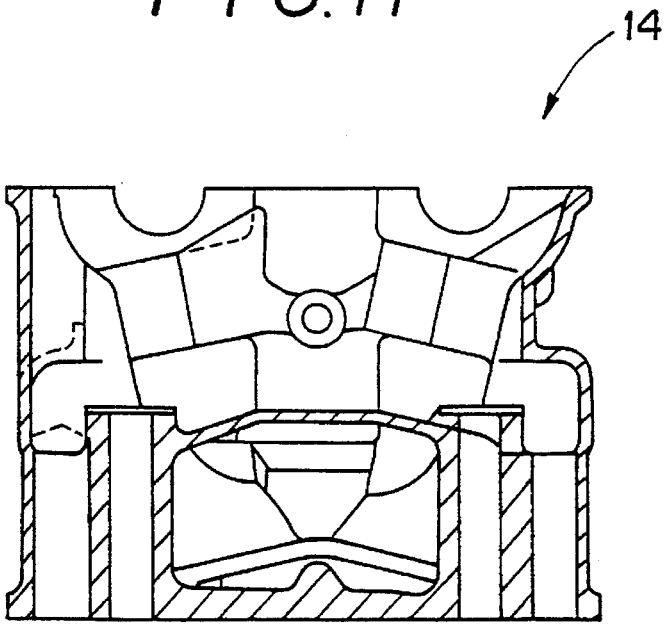
FIG. 11 is a cross-sectional view taken along line 11—11 of FIG. 9.

In the present embodiment, as illustrated in FIG. 1, the upper plate portion 30 defined with the coil-mounting portions 46 between the dented grooves 32 is also dented to form grooves 58. That is, denting is made to the upper plate portion 30 on the right side of FIG. 1 in the transverse direction perpendicular to axis C. The upper plate portion 30 is thereby formed with the communication grooves 58. The communication grooves 58 permit the dented grooves 32 to communicate with one another. In FIG. 1, the communication grooves 58 terminate at the peripheral flange portion 28 at an upper end of the head cover 26 in the longitudinal direction parallel to axis C.

Each of the communication grooves 58 is formed by a bottom plate portion 60 and side plate portions 62. The bottom plate portion 60 lies parallel to the upper plate portion 30. The side plate portions 62 are located at opposite sides of the bottom plate portion 60 in the transverse direction perpendicular to axis C. The bottom plate portions 60 of the communication grooves 58 continuously extend in a coextensive relationship with the bottom plate portions 34 of the dented grooves 32. The side plate portions 62 of the communication grooves 58, which are located on the right side in the transverse direction of FIG. 1, continuously extend in a coextensive relationship with the side plate portions 36 of the dented grooves 32 on the right side in the transverse direction of FIG. 1. The side plate portions 62 of the communication grooves 58, which are positioned on the left side in the transverse direction of FIG. 1, continuously extend in an intersecting relationship to the end plate portions 38 of the dented grooves 32.

Moreover, the head cover 26 has bleeder chambers 64 formed inside the upper plate portion 30 which is defined with the coil-mounting portions 46. The bleeder chambers 64 are located under one side of the upper plate portion 30 in the transverse direction perpendicular to axis C of the crank shaft 16. In the present embodiment, the bleeder chambers 64 are provided inside the upper plate portion 30 formed with the coil-mounting portions 46 as defined between the dented grooves 32. That is, the bleeder chambers 64 are formed inside the upper plate portion 30 on the left side of FIG. 1 in the transverse direction perpendicular to axis C.

The bleeder chambers 64 communicate with the existing bleeder chambers 66. The existing bleeder chambers 66 are positioned on opposite sides of the dented grooves 32 in the transverse direction perpendicular to axis C. Through the raising of the peripheral flange portion 28 and the upper plate portion 30 on both sides of the dented grooves 32 in the transverse direction of the head cover 26, the existing bleeder chambers 66 are defined by the peripheral flange portion 28, the upper plate portion 30, the side plate portions 36 of the dented grooves 32, and a bleeder plate 68.

The bleeder chambers 64, which are formed inside the upper plate portion 30 on the left side of FIG. 1 as previously described, are in communication with one of the aforesaid existing bleeder chambers 66.

Reference numeral 70 denotes a high-tension cord which is connected to the ignition coils 44.

Figure 13:
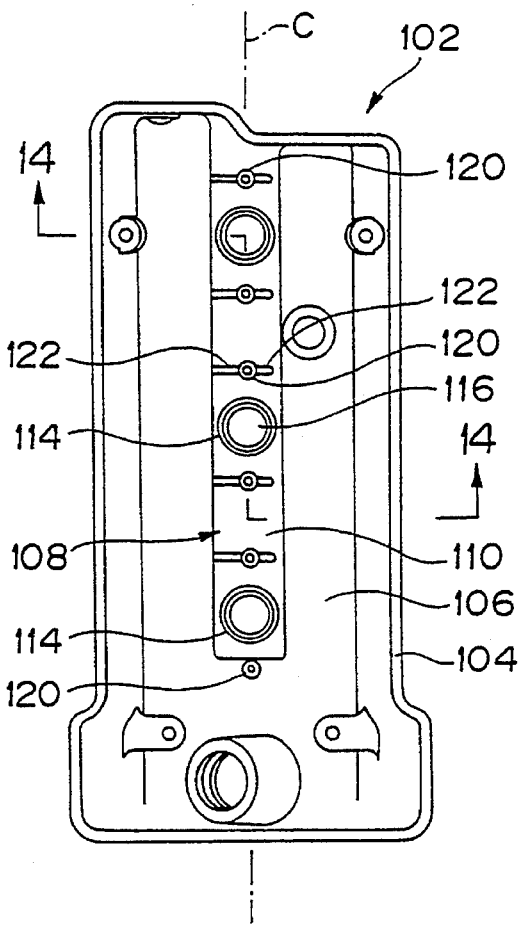
FIG. 13 PRIOR ART
FIG. 13 is a plan view illustrating a head cover according to the prior art.
Figure 14:
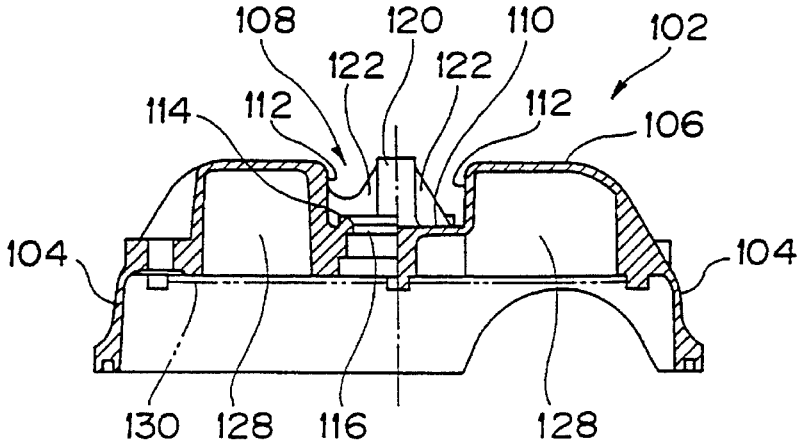
FIG. 14 PRIOR ART
FIG. 14 is an enlarged cross-sectional view taken along line 14—14 of FIG. 13.
Figure 15:
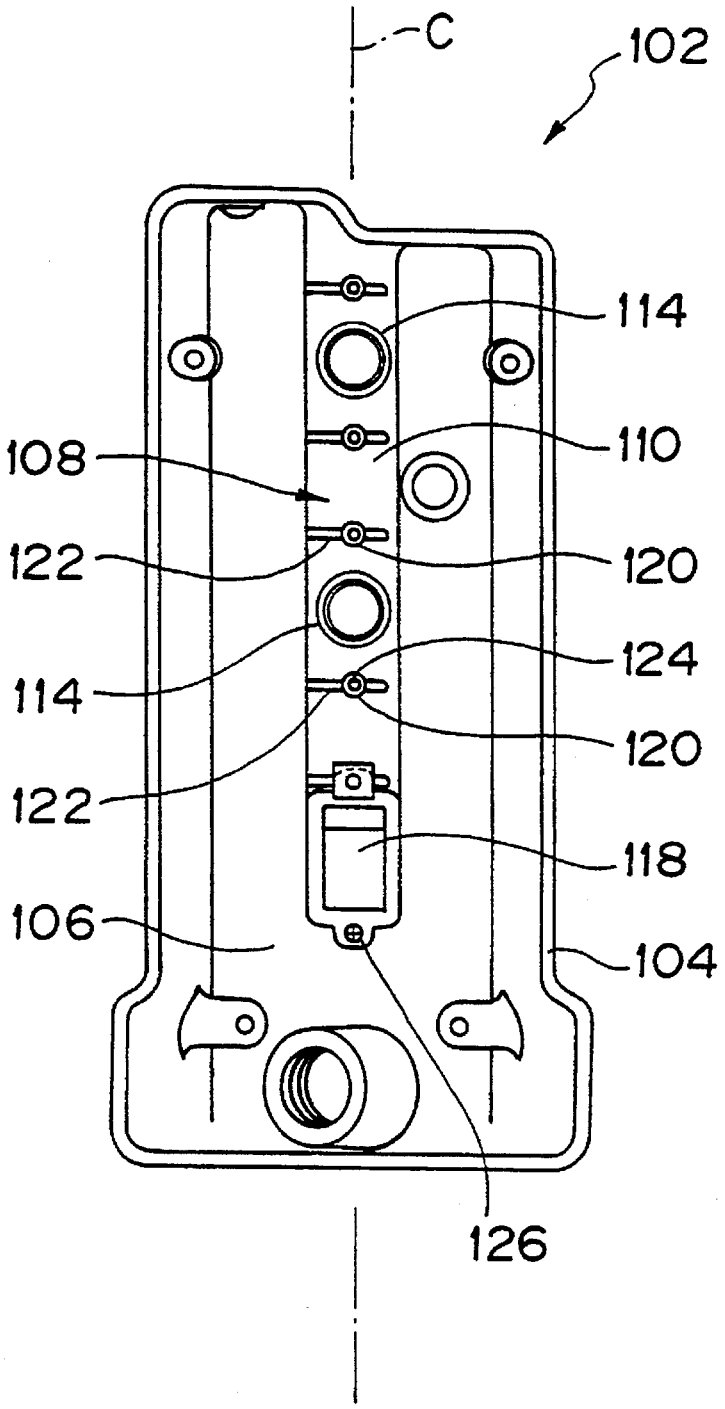
FIG. 15 PRIOR ART
FIG. 15 is a plan view of the prior art and illustrating a state in which the head cover is fitted with an ignition coil.

As detailed below, the head cover 26 is modified in construction with respect to a conventional head cover 102 as shown in FIGS. 13 through 15. In the structure of the conventional head cover 102, an upper plate portion 106 is formed with an elongated groove 108. The elongated groove 108 is provided by denting a central portion of the upper plate portion 106 in the transverse direction perpendicular to axis C of the crank shaft. The denting is executed to the point where the elongated groove 108 terminates at one end of the upper plate portion 106 in the longitudinal direction parallel to axis C. The elongated groove 108 has spark plug insertion-through-portions 114 defined at a bottom plate portion 110. The spark plug insertion-through-portions 114 are provided at respective positions corresponding to locations where a plurality of spark plugs are fitted in the cylinder head. The spark plugs are inserted through the spark plug insertion-through-portions 114. Further, there are provided coil-mounting portions 120 for ignition coils 118 to be mounted onto the spark plugs. The coil-mounting portions 120 are formed on both sides of the spark plug insertion-through-portions 114 in the longitudinal direction parallel to axis C of the crank shaft. The conventional head cover 102 also has side plate portions 112 located on both sides of the elongated groove 108 in the transverse direction perpendicular to axis C of the crank shaft.

However, in the head cover 26 according to the present invention, the side plate portion on one side are configured to extend close to the side plate portion on the other side without contacting the spark plug insertion-through-portions 40. The extended side plate portion surrounds the bottom plate portion of the elongated groove. The surrounded bottom plate portion 110 is configured with raised bottom plate portions defined with coil-mounting portions 46 for ignition coils to be connected to the spark plugs. Moreover, the bleeder chambers 64 according to the present invention are formed inside the head cover 26 at a location enclosed by the extended side plate portion 38 and the raised bottom plate portion.

Now, the operation of the present embodiment will be briefly described.

The engine 12 has a head cover 26 mounted on a cylinder head 14. Spark plugs 22 are inserted into the head cover 26 through spark plug insertion-through-holes 42 at spark plug-insertion-through-portions 40. Then, the spark plugs 22 are fitted into spark plug-tapped holes 24 through spark plug insertion holes 25 of the cylinder head 14.

The engine 12 is thereby provided with the plurality of spark plugs 22 at a central portion thereof in a transverse direction perpendicular to axis C of crank shaft 16. While being positioned above respective cylinders 20, the spark plugs 22 are aligned with one another in a longitudinal direction parallel to axis C of crank shaft 16.

Further, the spark plugs 22 are fitted with respective ignition coils 44. The ignition coils 44 are mounted on the cylinder head 14 by the engagement of coil side engagement holes 52 with coil engagement pins 48 of coil-mounting portions 46, and further by the threading engagement of coil-mounting screws 56, which are inserted through coil side insertion-through-holes 54, with coil-tapped holes 50 of the coil-mounting portions 46. The ignition coils 44 are thereby fitted directly onto head portions of the spark plugs 22.

The head cover 26 is further formed with dented grooves 32 and communication grooves 58. The communication grooves 58 intercommunicate the dented grooves 32, and terminate at a peripheral flange portion 28 at one end of the head cover 26 in the longitudinal direction parallel to axis C. As a result, when water or the like resides in the dented grooves 32 around the spark plug insertion-through-portions 40 of the head cover 26, such water is caused to flow to the aforesaid one end of the head cover 26, thereby being discharged outside.

As described above, the head cover 26 is mounted on the cylinder head 14 of the engine 12 in which the plurality of spark plugs 22 are located at the central portion of the cylinder head 14 in the transverse direction perpendicular to axis C of the crank shaft 16, while the spark plugs are aligned with one another along the longitudinal direction parallel to axis C of the crank shaft 16.

The head cover 26 is formed with the dented grooves 32. The dented grooves 32 are provided by deforming the upper plate portion 30 at respective regions which correspond to locations where the spark plugs 22 are fitted in the cylinder head 14.

For each of the dented grooves 32, a bottom plate portion 34 is formed with the spark plug insertion-through-portion 40, through which each of the spark plugs 22 is inserted. Further, the upper plate portion 30 has the coil-mounting portion 46 defined on each side of the spark plug insertion-through-portions 40 in the longitudinal direction parallel to axis C of the crank shaft 16. The coil-mounting portions 46 are provided for mounting the ignition coils 44 directly onto the spark plugs 22.

The head cover 26 is formed with the communication grooves 58. The communication grooves 58 are provided by deforming one side of the upper plate portion 30, as defined with the coil-mounting portions 46, in the transverse direction perpendicular to axis C of crank shaft 16. The communication grooves 58 intercommunicate the dented grooves 32. The communication grooves 58 open onto the peripheral flange portion 28 at one end of the head cover 26 in the longitudinal direction parallel to axis C of the crank shaft 16.

The head cover 26 is further provided with bleeder chambers 64 inside the upper plate portion 30 that is defined with the coil-mounting portions 46. The bleeder chambers 64 are located on the other side of the upper plate portion 30 in the transverse direction perpendicular to axis C of the crank shaft 16. The bleeder chambers 64 are communicated with one of existing bleeder chambers 66. The existing bleeder chambers 66 are positioned on both sides of the dented grooves 32 in the transverse direction perpendicular to axis C of the crank shaft 16.

As can be seen from the above description, the head cover 26 is formed with the dented grooves 32 and the communication grooves 58 through the steps of: deforming the upper plate portion 30 at respective regions corresponding to locations where the spark plugs 22 are fitted in the cylinder head 14, thereby providing the respective dented grooves 32; and, deforming the upper plate portion 30 to provide the communication grooves 58 which intercommunicate the dented grooves 32, the communication grooves 58 terminating at the peripheral flange portion 28 at one or both ends of the head cover 26 in the longitudinal direction thereof. The head cover 26 is thereby configured to have different cross-sectional groove shapes longitudinally therealong.

That is, the dented grooves 32 and the communication grooves 58 are formed in such a manner that the side plate portions 62 of the communication grooves 58, which are located on the right side in the transverse direction of FIG. 1, continuously extend in a coextensive relationship with the side plate portions 36 of the dented grooves 32 on the right side in the transverse direction of FIG. 1. Further, the dented grooves 32 and the communication grooves 58 are formed in such a manner that the side plate portions 62 of the communication grooves 58, which are positioned on the left side in the transverse direction of FIG. 1, continuously extend in an intersecting relationship to the end plate portions 38 of the dented grooves 32. As a result, the head cover 26 is configured to have different groove shapes in cross-section.

The above arrangement causes the following to be bent into a crank shape: the side plate portions 36 of the dented grooves 32 on the right side in the transverse direction; the wall plate portions 38 of the dented grooves 32; and, the side plate portions 62 of the communication grooves 58 on the left side in the transverse direction. This configuration can increase the strength of the head cover 26 without adding to the weight thereof. As a result, it is possible to increase the rigidity of the head cover 26, and to control noise emission and/or vibration resulting from actuation of the engine 12, whereby low noise and reduced vibration are achievable.

In addition, in the head cover 26, the upper plate portion 30 is formed with the coil-mounting portions 46 on both sides of the spark plug insertion-through-portions 40 in the longitudinal direction parallel to axis C of the crank shaft 16. The coil-mounting portions 46 are provided for mounting the ignition coils 44 directly onto the spark plugs 22.

The above structure eliminates the need for conventional practice in which the coil-mounting portions for the ignition coils to be mounted thereto are formed into a cylindrical shape. This feature can eliminate supporting ribs for enhancing the self-supporting rigidity of the conventional cylindrical coil-mounting portions. As a result, the head cover 26 can be made lighter in weight.

Moreover, denting is made to one side of the upper plate portion 30, which is defined with the coil-mounting portions 46, in the transverse direction perpendicular to axis C of the crank shaft 16. The head cover 26 thereby has the upper plate portion 30 formed with the communication grooves 58. The communication grooves 58 intercommunicate the dented grooves 32, and terminate at the peripheral flange portion 28 at one of the opposite ends of the head cover 26 in the longitudinal direction thereof. The head cover 26 further has the bleeder chambers 64 formed inside the upper plate portion 30 that is defined with the coil-mounting portions 46. The bleeder chambers 64 are positioned on the other side of the upper plate portion 30 in the transverse direction perpendicular to axis C of the crank shaft 16.

The above construction allows the head cover 26 to be newly formed with the bleeder chambers 64 for use in conjunction with the existing bleeder chambers 66, whereby an increased bleeder chamber capacity can be obtained. This feature can ensure a sufficient bleeder chamber capacity, and can enhance the performance of separating oil from blow-by gases. As a result, oil consumption can be reduced.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A head cover mountable on a cylinder head of an engine in which a plurality of spark plugs are disposed at a central portion of said cylinder head in a transverse direction perpendicular to an axis of a crank shaft, said plurality of spark plugs being aligned with one another in a longitudinal direction parallel to the axis of said crank shaft, said head cover comprising: an upper plate portion which is dented at respective regions corresponding to locations where said plurality of spark plugs are fitted in said cylinder head, wherein said upper plate portion is formed with dented grooves; said dented grooves having bottom plate portions defined with spark plug insertion-through-portions, through which said plurality of spark plugs are inserted and having opposing end plate portions on opposite sides of said spark plug insertion-through-portions facing along the longitudinal direction parallel to the axis of said crank shaft; said upper plate portion having coil-mounting portions formed on a first side thereof and disposed on said opposite sides of said spark plug insertion-through-portions in the longitudinal direction parallel to the axis of said crank shaft proximate said end plate portions, said coil-mounting portions being provided for mounting ignition coils directly onto said plurality of spark plugs; said first side of said upper plate portion, which is defined with said coil-mounting portions thereon, in the transverse direction perpendicular to the axis of said crank shaft, being dented to define at least one communication groove which intercommunicates with said dented grooves, said communication groove terminating at a peripheral plate portion of said head cover at one of opposite ends of said head cover in the longitudinal direction parallel to the axis of said crank shaft, wherein said upper plate portion is formed with said communication groove; and, said head cover has bleeder chambers formed inside said upper plate portion and defined by a second side of said upper plate portion opposite said first side that is defined with said coil-mounting portions, said bleeder chambers being positioned on at least one side of said communication groove of said upper plate portion in the transverse direction perpendicular to the axis of said crank shaft.

2. A head cover having an exterior side and an interior side and mountable on a cylinder head of an engine in which a plurality of spark plugs are disposed at a central portion of said cylinder head in a transverse direction perpendicular to an axis of a crank shaft, said plurality of spark plugs being aligned with one another in a longitudinal direction parallel to the axis of said crank shaft, said head cover comprising: an upper plate portion formed with dented grooves defined on two sides by two opposing end plate portions extending into the interior of the head cover and terminating at a bottom plate portion wherein said dented grooves are disposed at respective regions corresponding to locations where said plurality of spark plugs are fitted in said cylinder head, said bottom plate portion defining a spark plug insertion-through-portion, through which one of said plurality of spark plugs is inserted and said opposing end plate portions disposed on opposite sides of said spark plug insertion-through-portion and facing along a longitudinal direction parallel to the axis of said crank shaft, adjacent pairs of said dented grooves having said end plate portions thereof spaced apart one from the other;

coil mounting portions formed on the exterior side of said upper plate portion and disposed on said opposite sides of said spark plug insertion-through-portion proximate said end plate portions, said coil mounting portions being provided for mounting ignition coils directly onto said plurality of spark plugs;

said exterior side of said upper plate portion being dented in the transverse direction perpendicular to the axis of said crank shaft toward said bottom plate portion of said dented groove to define at least one communication groove in communication with said dented grooves and terminating at a peripheral plate portion of said head cover at one of opposite ends of said head cover in the longitudinal direction parallel to the axis of said crank shaft; and said head cover having first bleeder chambers formed within the interior of said upper plate portion between opposing interior sides of said end plate portions of said adjacent dented grooves, and at least one second bleeder chamber formed within the interior of said upper plate portion and in communication with said first bleeder chambers, said first and second bleeder chambers being disposed away from said communication grooves in the transverse direction perpendicular to the axis of said crank shaft.

* * * * *